US010954713B2

(12) United States Patent
Gagne et al.

(10) Patent No.: US 10,954,713 B2
(45) Date of Patent: Mar. 23, 2021

(54) STRUCTURAL BONDING COMPOSITE

(71) Applicant: Tremco Incorporated, Beachwood, OH (US)

(72) Inventors: Brian M. Gagne, Lyndhurst, OH (US); Michael Sebold, Cleveland, OH (US); David M. Horschig, Wildwood, MO (US); Maneesh Bahadur, Mayfield Heights, OH (US)

(73) Assignee: Tremco Incorporated, Beachwood, OH (US)

( * ) Notice: Subject to any disclaimer, the term of this patent is extended or adjusted under 35 U.S.C. 154(b) by 0 days.

(21) Appl. No.: 16/478,332

(22) PCT Filed: Jan. 18, 2018

(86) PCT No.: PCT/US2018/014133

§ 371 (c)(1),
(2) Date: Jul. 16, 2019

(87) PCT Pub. No.: WO2018/136578

PCT Pub. Date: Jul. 26, 2018

(65) Prior Publication Data

US 2019/0390506 A1 Dec. 26, 2019

Related U.S. Application Data

(60) Provisional application No. 62/447,573, filed on Jan. 18, 2017.

(51) Int. Cl.

| | |
|---|---|
| ***E06B 3/54*** | (2006.01) |
| ***E06B 3/56*** | (2006.01) |
| *E06B 3/62* | (2006.01) |

(52) U.S. Cl.

CPC ..... *E06B 3/5427* (2013.01); *E06B 3/5409* (2013.01); *E06B 3/56* (2013.01); *E06B 2003/6273* (2013.01)

(58) Field of Classification Search

CPC ..... E06B 3/5427; E06B 3/5409; E06B 3/56; E06B 2003/6273

See application file for complete search history.

(56) References Cited

U.S. PATENT DOCUMENTS 2,781,561 A * 2/1957 Gifford ..... E06B 3/62 52/204.591
4,754,585 A * 7/1988 Rundo ..... E06B 3/5418 52/202

(Continued)

FOREIGN PATENT DOCUMENTS

DE 3808978 A1 9/1989
DE 4204799 A1 8/1993

(Continued)

OTHER PUBLICATIONS

Search Report and Written Opinion for International Application No. PCT/US2018/014133 dated Jun. 1, 2018.

(Continued)

*Primary Examiner* — Joshua K Ihezie
(74) *Attorney, Agent, or Firm* — Calfee, Halter & Griswold LLP

(57) ABSTRACT

A structural bonding composite includes a polymeric base member, a first structural adhesive layer on a first side of the base member, a second structural adhesive layer on a second side of the base member opposite the first side, and a reinforcement member secured to a portion of the base member to maintain a predetermined thickness of the base member against compression applied to the first and second sides of the base member.

26 Claims, 4 Drawing Sheets

(56) References Cited

U.S. PATENT DOCUMENTS

| | | | | | |
|---|---|---|---|---|---|
| 4,873,803 | A * | 10/1989 | Rundo | E06B 3/5418 | 52/202 |
| 5,300,171 | A * | 4/1994 | Braun | C09J 183/04 | 156/249 |
| 8,141,324 | B2 * | 3/2012 | Carbary | C09J 7/26 | 52/745.15 |
| 2009/0301006 | A1 * | 12/2009 | Karrer | E06B 3/56 | 52/204.6 |
| 2016/0138323 | A1 * | 5/2016 | Sonderk R | E06B 3/66 | 52/173.1 |
| 2017/0275876 | A1 * | 9/2017 | Mucha | E04D 13/031 | |

FOREIGN PATENT DOCUMENTS

| | | | |
|---|---|---|---|
| EP | 333074 | A1 | 9/1989 |
| EP | 03336097 | A1 | 10/1989 |
| GB | 1189518 | A | 4/1970 |

OTHER PUBLICATIONS

International Preliminary Report on Patentability for International Application No. PCT/US2018/014133 dated Jul. 23, 2019.

* cited by examiner

STRUCTURAL BONDING COMPOSITE

This application claims priority to and all benefit of U.S. Provisional Patent Application Ser. No. 62/447,573, filed Jan. 18, 2017, titled STRUCTURAL BONDING TAPE, the entire disclosure of which is fully incorporated herein by reference.

BACKGROUND

Structural glazing in building construction, for example, in window, window wall, curtainwall, storefront, custom windows, entrances or related façade fabrication and installation, typically involves use of structural silicone sealant or other structural bonding adhesives, injected or otherwise placed in a cavity formed, for example, by a fenestration panel, frame member, and a spacer component that maintains a predetermined gap (e.g., ¼ inch) between the fenestration panel and the frame member. The required curing time for this structural sealant has created fabrication schedule challenges in the construction industry.

SUMMARY

The present application contemplates inventive structural bonding composites for bonding a surface of a building panel (e.g., a fenestration unit) to a surface of a framing member, while maintaining a predetermined (e.g., by industry standard) face clearance between the bonded surfaces.

Accordingly, in an exemplary embodiment of the present application, a structural bonding composite includes a polymeric base member, a first structural adhesive surface on a first side of the base member, a second structural adhesive surface on a second side of the base member opposite the first side, and a reinforcement member secured to a portion of the base member to maintain a predetermined thickness of the base member against compression applied to the first and second sides of the base member. The first and second structural adhesive surfaces provide a bonding tensile strength in accordance with ASTM C1401.

In another exemplary embodiment of the present application, a glazing system includes a fenestration unit having opposed first and second major surfaces, a frame member having a first major surface facing the first major surface of the fenestration unit, and a structural bonding composite interposed between the first major surface of the frame member and the first major surface of the fenestration unit. The structural bonding composite includes a polymeric base member, first and second structural adhesive surfaces on first and second sides of the base member, bonded to the first major surface of the frame member and the first major surface of the fenestration unit, respectively. The structural bonding composite further includes a reinforcement member secured to a portion of the base member to maintain a predetermined thickness of the base member against compression between the first and second major surfaces corresponding to a required face clearance between the first major surfaces of the fenestration unit and the frame member. The structural bonding composite independently provides a sufficient bond (e.g., in accordance with ASTM C1401 and/or ASTM C1184) of the fenestration unit to the frame member without other fastening materials.

In another exemplary embodiment of the present application, a fenestration supporting frame member is provided in combination with a structural bonding composite. The structural bonding composite includes a polymeric base member and a first structural adhesive surface on a first side of the base member, the first structural adhesive surface bonding the first side of the base member to a first major surface of the frame member. A second structural adhesive surface is disposed on a second side of the base member opposite the first side, and a reinforcement member is secured to a portion of the base member to maintain a predetermined thickness of the base member against compression applied to the first and second sides of the base member. The first and second structural adhesive surfaces provide a bonding tensile strength in accordance with ASTM C1401.

In another exemplary embodiment of the present application, a method of installing a fenestration unit is contemplated. In the exemplary method, a frame member is provided, having a first major surface with a structural bonding composite adhered to the first major surface, with the structural bonding composite including a polymeric base member, a first structural adhesive surface on a first side of the base member and bonded to the first major surface of the frame member, and a second structural adhesive surface on a second side of the base member opposite the first side. A first major surface of a fenestration unit is adhered to the second structural adhesive surface to permanently bond the fenestration unit to the frame member, wherein the structural bonding composite independently provides a sufficient bond (e.g., in accordance with ASTM C1401) of the fenestration unit to the frame member without other fastening materials.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to provide examples of the principles of this invention.

DETAILED DESCRIPTION

As described herein, when one or more components are described as being assembled, connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

The Detailed Description merely describes exemplary embodiments and is not intended to limit the scope of the claims in any way. Indeed, the invention as claimed and described is broader than and unlimited by the exemplary embodiments, and the terms used in the claims have their full ordinary meaning. For example, while the specific embodiments described herein relate to structural bonding composites for use in fenestration systems (e.g., products including glass or other transparent or translucent materials, fixed or movable windows, opaque doors or panels, glazed doors or panels, skylights, sloped glazing, window walls, curtainwalls, storefronts, custom windows, entrances or façades), the inventive components, combinations, systems, and methods described herein may additionally or alternatively be applied to other types of bonding composites, other construction systems and assemblies, and other uses.

As used herein, "composites" may include structural glazing and insulated glass construction parts fabricated using one or more layers of compatible homogeneous polymeric materials that are assembled and cured in any suitable standard or customized geometric shape. Examples of composite materials include any one or more of: (a) extrusions including, for example, rubber extrusions and cellular rubber extrusions comprising polymers such as silicones, EPDM, neoprene etc.; (b) tapes including, for example, glazing tapes comprising polymers such as butyl, silicones, acrylates, and urethanes; (c) gaskets including, for example, compression gaskets comprising polymers such as butyl, silicones, acrylates, and urethanes; (d) foams including, for example, open cell and closed cell foams comprising polymers such as butyl, silicones, acrylates, and urethanes; and (e) other accessories such as wedges, pre-set spacers, weather stripping, shims comprised from polymers such as butyl, silicones, acrylates, and urethanes. A composite may additionally or alternatively include a base layer composite (e.g., any one or more of the examples described above), and a curable adhesive layer on one or more sides of the base layer.

Figure 1:
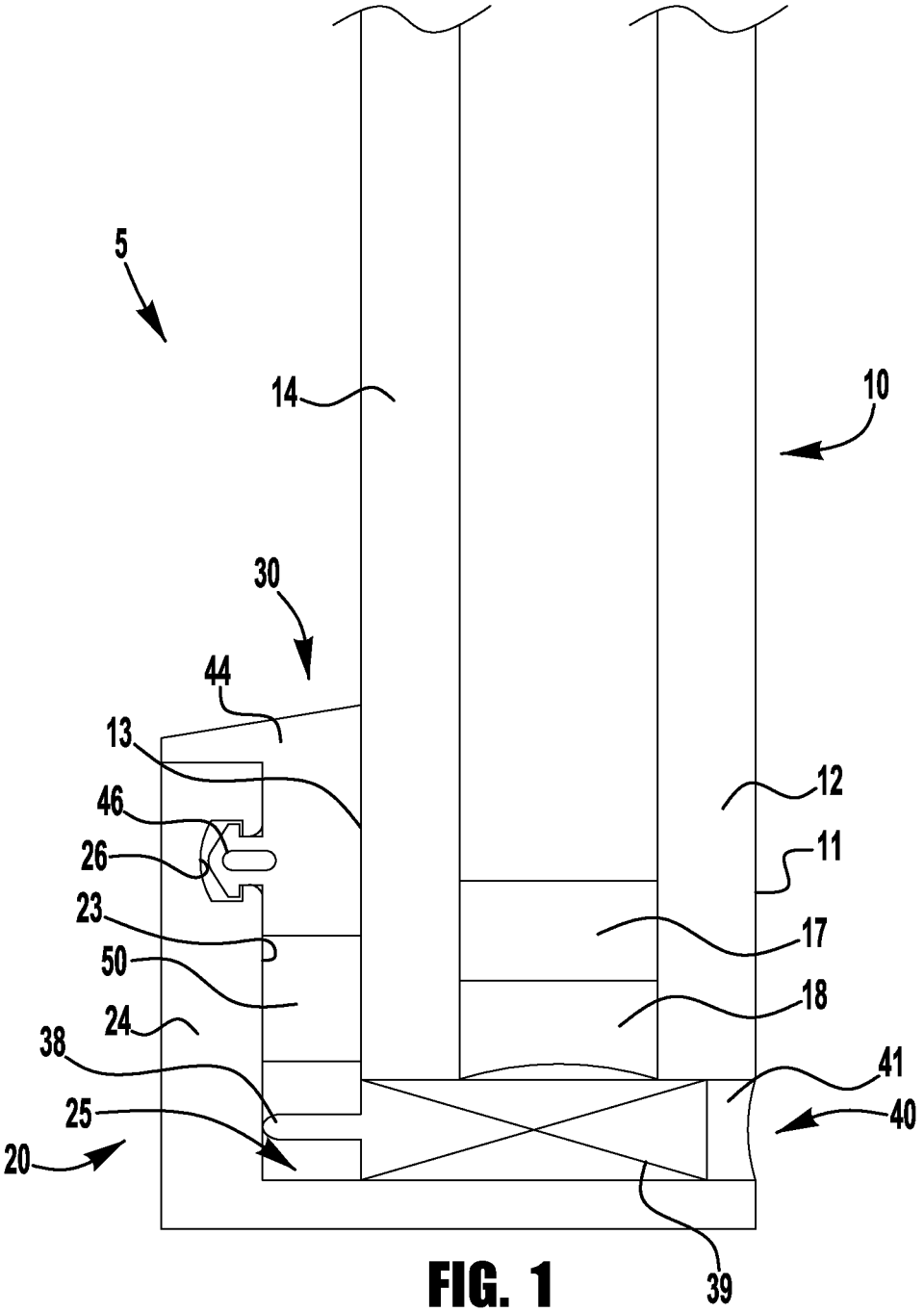
FIG. 1 is a partial cross-sectional schematic view of an exemplary glazing system.

FIG. 1 schematically illustrates a partial cross-sectional view of an exemplary fenestration or glazing system 5, including a fenestration unit 10 (e.g., a dual pane glass unit), a frame member 20, an interior seal arrangement 30 between the frame member 20 and the fenestration unit 10, and an exterior seal arrangement 40 between the frame member 20 and the fenestration unit 10. The exemplary frame member 20 includes an interior stop 24 defining a retaining surface 23 that faces an interior surface 13 of the fenestration unit 10.

In the illustrated embodiment, the exterior surface 11 of the fenestration unit 10 is defined by an outer pane 12 and the interior surface 13 of the fenestration unit is defined by an inner pane 14 separated from the outer pane by a spacer 17 and a secondary seal 18. In other embodiments (not shown), the fenestration unit may include a single pane defining both interior and exterior surfaces. The edge portion 15 of the fenestration unit 10 is spaced from an inner surface of a glazing pocket 25 in the frame member 20 by a setting block 39 or other spacer component for limiting longitudinal movement of the fenestration unit with respect to the frame member 20. As shown, the setting block 39 is provided with an outer projection 38 that engages the retaining surface 23 of the frame member 20 to align the setting block with the fenestration unit edge portion 15.

The interior seal arrangement 30 of the exemplary embodiment includes a structural bonding element 50 adhered between the retaining surface 23 of the interior stop 24 and the inner pane 14. A gasket 44 may be provided adjacent to the bonding element 50 to provide sealing reinforcement between the interior stop 24 and the inner pane 14. As shown, the gasket 44 may include a dart 46 or other such projection that interlocks with a corresponding slot or gasket raceway 26 in the frame member 20. In another embodiment, the interior stop may be provided as a removable stop (as known in the art), for example, to facilitate installation. The exterior seal arrangement 40 of the exemplary embodiment includes a suitable sealant 41, such as, for example, exterior "weather sealing" sealant materials.

In a conventional glazing system, the bonding element is a sealant (e.g., a silicone sealant or adhesive) that provides a permanent bond between the fenestration unit and the frame member. According to an exemplary aspect of the present application, the need for a sealant applied between the interior stop and the interior surface of the fenestration unit may be eliminated by utilizing a structural bonding composite having a thickness sufficient to maintain a predetermined (e.g., industry specified) face clearance (e.g., ¼ inch) which providing sufficient bonding tensile strength and shear strength to bond the fenestration unit to the frame member against longitudinal and lateral forces. Bonding tensile strength and shear strength properties may be in accordance with ASTM C1401, or any other appropriate industry standards. By excluding the conventional bonding element sealant from the bonded glazing assembly, wait times for sealant/adhesive are minimized, thereby improving fabrication schedules, manufacturing efficiency, and building project construction schedules for enclosing the structure. In one exemplary embodiment, a frame member may be provided with a structural bonding composite pre-applied to the frame member by a frame fabricator (e.g., with a release liner applied to the exposed adhesive layer) to eliminate this assembly step. In another exemplary embodiment, a frame member extrusion may be provided with a structural bonding composite pre-applied to the frame member extrusion (e.g., after painting or anodizing the extrusion), with the extrusion being provided to a fabricator to cut the extrusion with pre-applied bonding composite into desired lengths for frame fabrication. In such an arrangement, the bonding composite may be rated to withstand extreme high temperatures beyond the expected service temperatures (e.g., temperatures exceeding typical aluminum saw temperatures, for example, by about 200° F.), to withstand exposure to heat resulting from cutting the extrusion (e.g., with a chop saw).

Figure 1B:
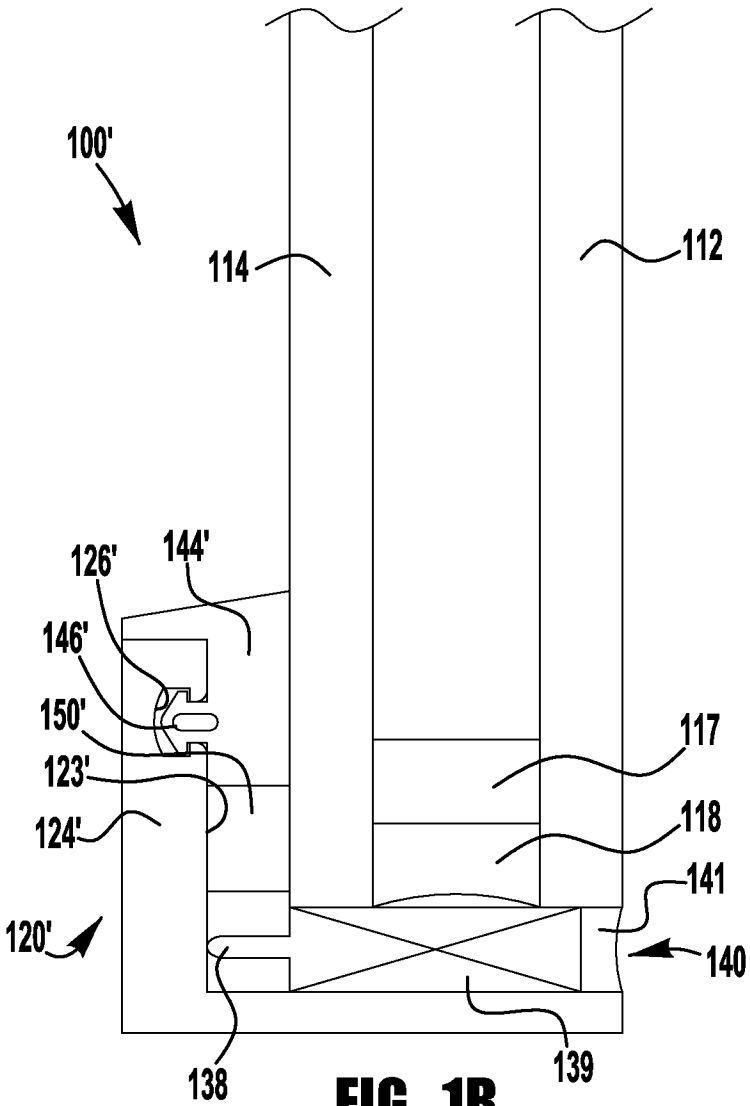
FIG. 1B is a partial cross-sectional schematic view of another exemplary glazing system including a structural bonding composite including a reinforcement member, in accordance with another exemplary embodiment of the present application.
Figure 1A:
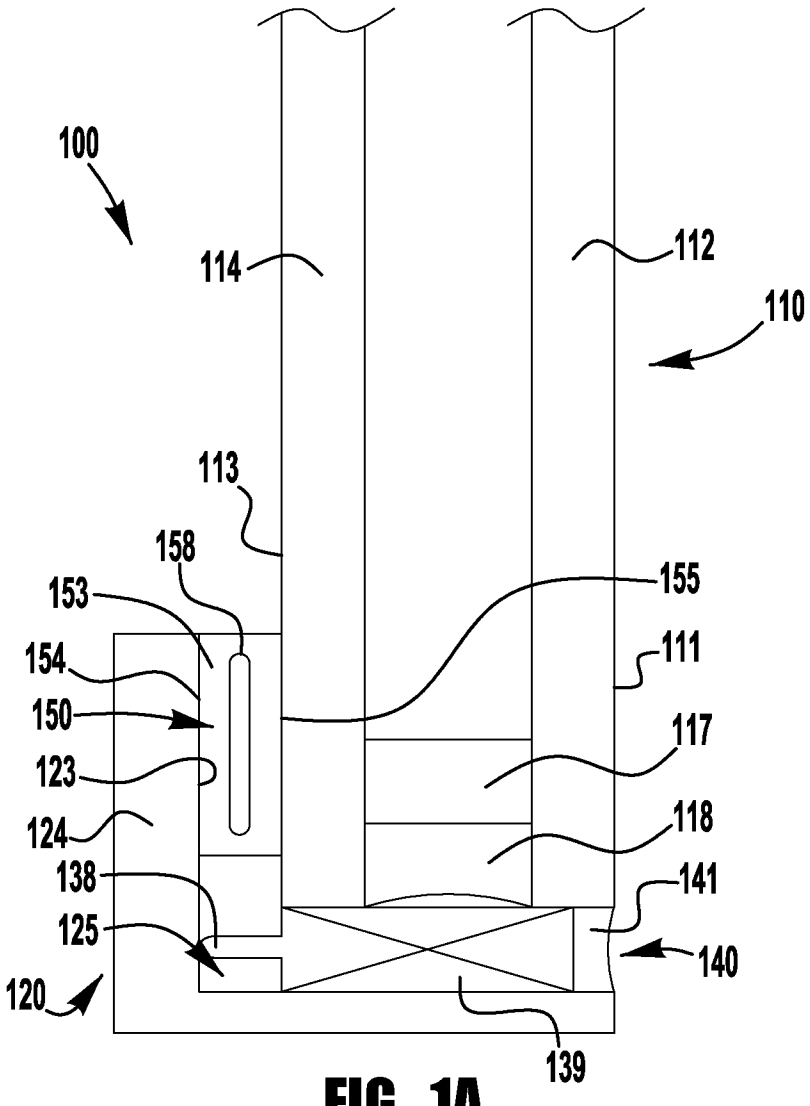
FIG. 1A is a partial cross-sectional schematic view of an exemplary glazing system including a structural bonding composite including a reinforcement member, in accordance with an exemplary embodiment of the present application.

FIG. 1A illustrates a partial cross-sectional view of an exemplary fenestration or glazing system 100, similar to the fenestration system 5 of FIG. 1, with the structural bonding element comprising a structural bonding composite 150, as described in greater detail below, having a base member 153, a first adhesive surface 154 disposed on a first side of the base member and adhered to the retaining surface 123 of the interior stop 124, and a second adhesive surface 155 disposed on a second side of the base member 153 and adhered to the interior surface 113 of the inner pane 114.

In the illustrated embodiment, the base member 153 of the structural bonding composite 150 includes a material configured to provide compressibility and tensile and shear strength in a wide range of temperatures (e.g., about −40° F. to about 200° F.). The base member 153 may be a polymeric component (e.g., a polymer, reinforced polymer, or polymer composite). While many different materials and methods of construction may be utilized, in an exemplary embodiment, the base member may include one or more of a rubber (e.g., cross-linked rubber), open or closed cell foam, viscoelastic foam, or plastic material (e.g., constructed from urethane, acrylic, and/or silicone), and may be formed, for example, by molding, extrusion, machining, or 3D printing. The first and second adhesive layers 154, 155 are selected to provide superior bonding tensile strength to the fenestration unit surface material (e.g., glass, stone, metal panel etc.) and to the frame member material (e.g., metals such as aluminum of various finishes, or stainless steel). While many different materials may be utilized, in an exemplary embodiment, the adhesive layers may include one or more of acrylic and silicone. In an exemplary embodiment, for superior bonding tensile strength, the adhesive may undergo a curing reaction upon contact with the frame member material. This curing reaction may result in a viscoelastic polymer composition changing into a solid elastomeric adhesive. The curing reaction can be initiated in several different ways after contact with the frame member, including, for example, heating the adhesive composition, exposing the uncured material to an activating radiation source or electron beam energy, or allowing the ambient moisture to trigger the cure to form an adhesive layer with superior bonding tensile strength.

Currently available structural bonding tapes, such as, for example, VHB Tape products manufactured by 3M, ACX Plus bonding products manufactured by Tesa, and Gaska tape products, are limited in thickness (typically up to 0.09 inches thick), such that these bonding products are unable to adequately maintain industry specified glass face clearance requirements (e.g., a ¼ inch clearance requirement). In addition, these tape products employ a pressure-sensitive tape adhesive which might be employed in a film or a fibrous backing. This pressure sensitive adhesive often deteriorates during periods of storage and becomes soft and low in adhesive and cohesive strength when the tape product is stored in roll form. Merely providing similar bonding products having an increased thickness, with a deterioration in their cohesive strength with storage in the roll form, presents challenges with regard to limiting compression and expansion of the base material during wind loading, and supporting the bonding tape against shear forces, for example, due to thermal expansion and contraction or seismic activity. According to an inventive aspect of the present application, a structural bonding composite provided with a compressible base member sized to maintain adequate face clearance may additionally be provided with a reinforcement member secured to (e.g., encapsulated by, sandwiched between or attached to) the base member to maintain a predetermined thickness of the base member against compression applied to the sides of the base member (e.g., compression between the fenestration unit and the frame member). In the embodiment of FIG. 1A, a compression limiting reinforcement member is schematically represented at reference 158. The bonding composite may be provided with an uncompressed thickness sufficiently greater than the limited compressed thickness to support adequate adhesion between the composite and the bonded surfaces. In an exemplary embodiment, a structural bonding composite configured for a ¼ inch compressed thickness may have an uncompressed thickness of about 5/16". In other embodiments, other desired compressed and uncompressed thicknesses may be utilized.

As shown in FIG. 1A, the use of a structural bonding composite may eliminate the need for an internal gasket between the interior surface of the fenestration unit 110 and the frame member 120. In other embodiments, as shown in FIG. 1B and described in greater detail below, a glazing system 100' may be provided with an internal gasket 144' in combination with a structural bonding composite 150' for a reinforced bond.

Figure 2:
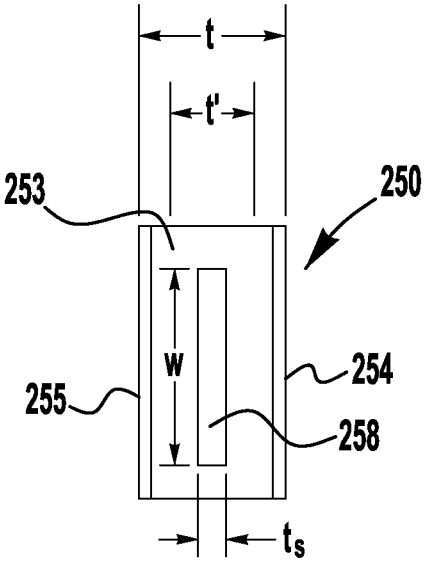
FIG. 2 is a cross-sectional schematic view of a structural bonding composite having an encapsulated shim, in accordance with another exemplary embodiment of the present application.

Many different types of reinforcement members may be utilized with a structural bonding composite in accordance with the present application. In an exemplary embodiment, at least one reinforcement member may be disposed within the base member (e.g., encapsulated within or sandwiched between layers of the base member) to limit compression of the base member. FIG. 2 illustrates an exemplary structural bonding composite 250 including a compressible (e.g., viscoelastic) base member 253 having adhesive first and second side surfaces 254, 255 defining a non-compressed thickness t. While the base member 253 may itself define the adhesive surfaces 254, 255, in other embodiments, adhesive layers or coatings may be applied to the sides of the base member to define the adhesive surfaces.

Figure 2A:
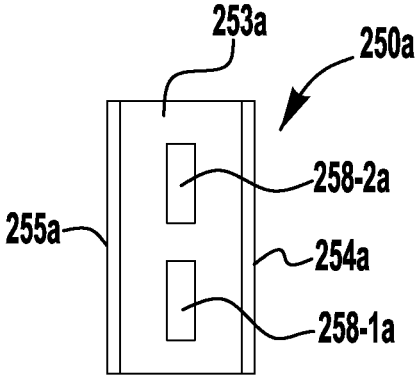
FIG. 2A is a cross-sectional schematic view of a structural bonding composite having a plurality of encapsulated shims, in accordance with another exemplary embodiment of the present application.

The base member 253 encapsulates a rigid plate, shim, or other such internal reinforcement member 258 extending along a length of the bonding composite 250. The shim 258 may be provided in a substantially or relatively incompressible material, such as, for example, EPDM, Silicone, PVC, or aluminum. The shim 258 may be provided with a thickness $t_s$ (e.g., approximately 20-30% of the composite thickness t, or about 0.03" to 0.09" for a composite having a thickness compression limit of ¼ inch) selected to effectively limit the compressed thickness of the bonding composite 250, for example, to a predetermined allowable compressed thickness t' (e.g., corresponding to an industry specified face clearance, such as, for example, ¼ inch). The shim may be provided in any suitable cross-sectional shape, including, for example, rectangular, circular, oval, trapezoidal, and square. The shim 258 may be provided in a width w sufficient to maintain uniform compression of the composite (e.g., 60-100% of the composite width). Alternatively, as shown in FIG. 2A, the base member 253*a* may encapsulate a plurality of narrower shims 258-1*a*, 258-2*a* spaced apart and arranged to similarly limit and maintain uniform compression of the composite 250*a*.

Figure 3:
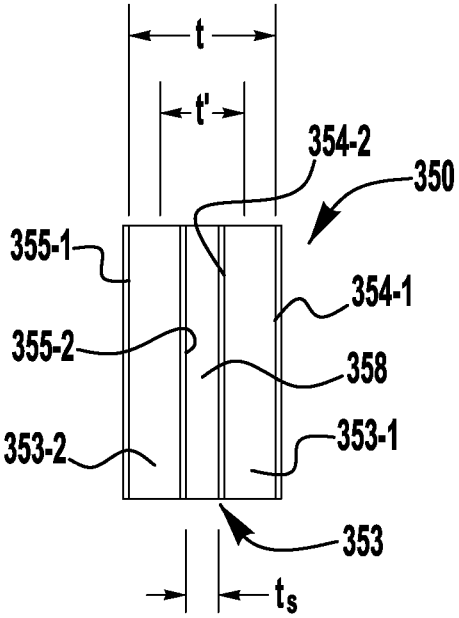
FIG. 3 is a cross-sectional schematic view of a structural bonding composite having a sandwiched shim, in accordance with another exemplary embodiment of the present application.

FIG. 3 illustrates another exemplary structural bonding composite 350 including a multi-layered compressible (e.g., viscoelastic) base member 353, including first and second base layers 353-1, 353-2 and a rigid plate, shim or other such reinforcement member 358 sandwiched between the base layers 353-1, 353-2 and extending along a length of the bonding composite 350. The shim 358 may be provided in a substantially or relatively incompressible material, such as, for example, EPDM, Silicone, PVC, or aluminum. The shim 358 may be provided with a thickness $t_s$ (e.g., 20-30% of the composite thickness t, or about 0.03-0.09 for a composite having a thickness compression limit of ¼ inch) selected to effectively limit the compressed thickness of the bonding composite 350, for example, to a predetermined allowable compressed thickness t' (e.g., corresponding to an industry specified face clearance, such as, for example, ¼ inch). The shim 358 may, but need not, be provided in a width substantially equal to the width of the base layers 353-1, 353-2 sufficient to maintain uniform compression of the composite (e.g., 80-120% of the composite width). Adhesive surfaces 354-1, 354-2, 355-1, 355-2 for bonding the composite to the frame member and fenestration unit, and for bonding the base layers 353-1, 353-2 to the shim 358, may be defined by the base layer material, or may be defined by adhesive layers or coatings applied to the sides of the base layers.

In an exemplary embodiment, the adhesive layers or coatings applied to the sides of a base layer of a structural bonding composite include one or more silicones. Silicones are synthetic polymeric materials that possess an extraordinarily wide range of physical properties. They can be low- or high-viscosity liquids, solid resins, or vulcanizable gums. They display an unusual combination of organic and inorganic chemical properties that are due to their unique molecular structure of alternating silicon and oxygen atoms shown below:

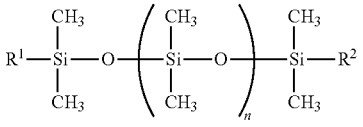

For superior bonding tensile strength, the silicone adhesive curing reaction will result in development of a "cross-linked" elastomer from relatively low molecular weight viscoelastic polymers by means of a chemical reaction that forms these crosslinks and effectively extends chain length after contact to the frame member material resulting in a superior bonding tensile strength. There are many types of curing silicones. Such systems may include (i) addition-cured, e.g., hydrosilylation cured (alternatively spelled "hydrosilation") silicones, (ii) radiation cure silicone, and/or (iii) condensation-cured silicones.

Addition-cured silicones (e.g., hydrosilylation cured silicones) do not produce by-products during curing. An adhesive based on this cure system is of higher quality and more dimensionally stable, and are a more preferred cure system. The addition cured composition typically contains: (1) a polymer which contains two or more vinyl functional groups; (2) a "hydrosilane" crosslinker component containing two or more SiH bonds; and (3) a precious metal catalyst such as a platinum catalyst. An exemplary addition-cured silicone is formed by reacting (1) a multiply-vinyl-containing organopolysiloxane with (2) an organopolysiloxane containing a multiplicity of SiH bond per molecule. This reaction is typically facilitated by the presence of (3) a platinum catalyst of the Karstedt type.

Radiation cure silicones do not produce by-products during curing. An adhesive based on this cure system is of higher quality and more dimensionally stable, and are a more preferred cure system. The radiation-cured composition typically includes (1) silicone compounds exhibiting acrylic or epoxy functionality, or both, (2) a catalytic amount of a photoinitiator comprising an onium salt cationic photoinitiator or a silicone-soluble free-radical photoinitiator, or a mixture thereof, and (3) additives such as reactive diluents, tackifiers for superior bonding tensile strength.

Condensation-cured silicone adhesives cure a by-product such as water or alcohol while under-going the crosslinking reaction. Condensation cure is preferred as a secondary cure for the adhesive for superior bonding tensile strength.

Figure 3A:
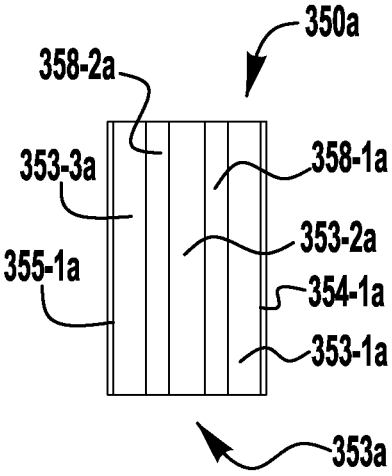
FIG. 3A is a cross-sectional schematic view of a structural bonding composite having a plurality of sandwiched shims, in accordance with another exemplary embodiment of the present application.

In other embodiments, as shown in FIG. 3A, the base member 353*a* may include three (or more) base layers 353-1*a*, 353-2*a*, 353-3*a*, with a rigid plate or shim 358-1*a*, 358-2*a* bonded between adjacent base layers (e.g., by adhesive layers, not shown) to similarly limit and maintain uniform compression of the composite 350*a*.

Figure 4:
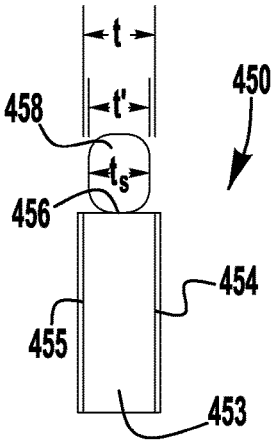
FIG. 4 is a cross-sectional schematic view of a structural bonding composite having a laterally bonded reinforcement member, in accordance with another exemplary embodiment of the present application.
Figure 4A:
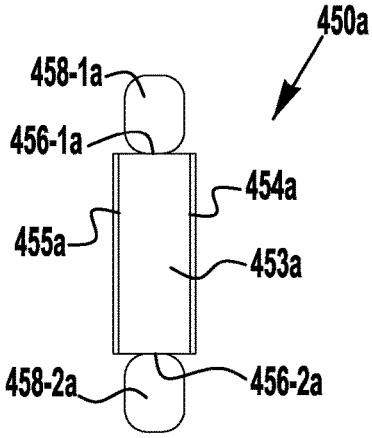
FIG. 4A is a cross-sectional schematic view of a structural bonding composite having two laterally bonded reinforcement members, in accordance with another exemplary embodiment of the present application.

In another exemplary embodiment, at least one reinforcement member may be bonded or otherwise attached to a lateral edge portion of the composite's base member. Any suitable bonding or attachment may be utilized, including, for example, at least one of acrylic and silicone. FIG. 4 illustrates an exemplary structural bonding composite 450 including a compressible (e.g., viscoelastic) base member 453 having adhesive side surfaces 454, 455 (either defined by the base member or by adhesive layers/coatings, as described above) defining a non-compressed thickness t and bonded along a first lateral edge 456 to a relatively rigid (or of limited compressibility) spacer or other such reinforcement member 458 extending along a length of the bonding composite 450. The reinforcement member 458 may be provided in a substantially or relatively incompressible material, such as, for example, a rubber, thermal plastic, or metal material. The member 458 may be provided in a material (or coated with a material) selected to prevent damage to the bonded surfaces. The reinforcement member 458 may be provided with a thickness $_{ts}$ selected to effectively limit the compressed thickness of the bonding composite 450, for example, to a predetermined allowable compressed thickness t' (e.g., corresponding to an industry specified face clearance, such as, for example, ¼ inch). In another embodiment, as shown in FIG. 4A, reinforcement members 458-1*a*, 458-2*a* may be bonded or otherwise attached to both lateral edges 456-1*a*, 456-2*a* of the base member 453*a* to similarly limit and maintain uniform compression of the composite 450*a*.

Figure 5:
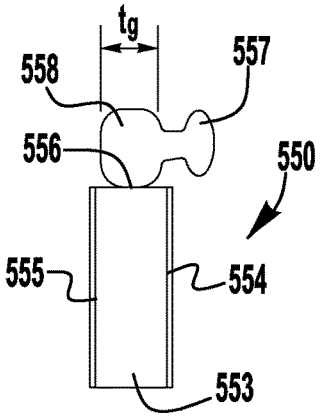
FIG. 5 is a cross-sectional schematic view of a structural bonding composite having a bonded reinforcing gasket, in accordance with another exemplary embodiment of the present application.

The laterally bonded reinforcement member 458 of FIG. 4 may take a variety of forms. In one exemplary embodiment, a sufficiently rigid gasket (i.e., of limited compressibility) that provides a seal between the fenestration unit and the inner stop of the frame member (e.g., similar to the gasket 144' of FIG. 1B) may be bonded or otherwise attached to a lateral edge of a bonding composite base member to additionally function as a compression limiting reinforcement member. FIG. 5 illustrates an exemplary structural bonding composite 550 including a compressible (e.g., viscoelastic) base member 553 having adhesive side surfaces 554, 555 (either defined by the base member or by adhesive layers/coatings, as described above) and bonded along a first lateral edge 556 to a relatively rigid (or of limited compressibility) gasket 558 (e.g., a preset dense gasket) extending along a length of the bonding composite 550. The gasket 558 may be provided in any suitable material, such as, for example, rubber, elastomer, or thermal plastic. As shown, the gasket 558 may include a ridge, dart, flange, or other such interlocking portion 557 for interlocking engagement with an exterior stop of a frame member (as shown in FIG. 1). The gasket 558 may be provided with a thickness $t_g$ selected to effectively limit the compressed thickness of the bonding composite 550, for example, to a predetermined allowable thickness (e.g., corresponding to an industry specified face clearance, such as, for example, ¼ inch).

Figure 6:
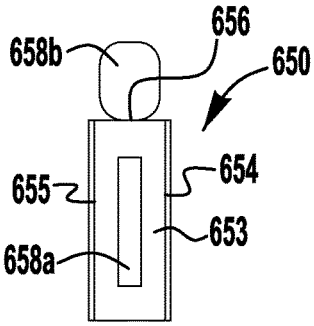
FIG. 6 is a cross-sectional schematic view of a structural bonding composite having an encapsulated shim and a laterally bonded reinforcement member, in accordance with another exemplary embodiment of the present application.
Figure 7:
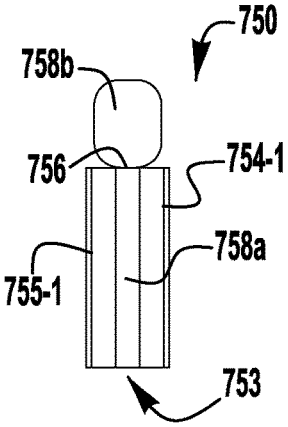
FIG. 7 is a cross-sectional schematic view of a structural bonding composite having an sandwiched shim and a laterally bonded reinforcement member, in accordance with another exemplary embodiment of the present application.
Figure 8:
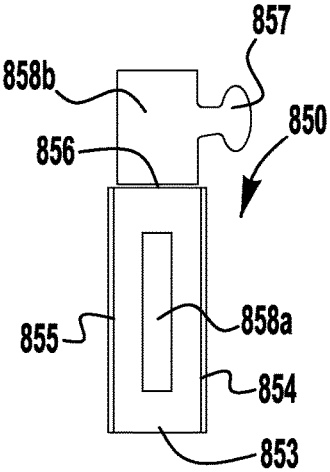
FIG. 8 is a cross-sectional schematic view of a structural bonding composite having a bonded reinforcing gasket and an encapsulated shim, in accordance with another exemplary embodiment of the present application.
Figure 9:
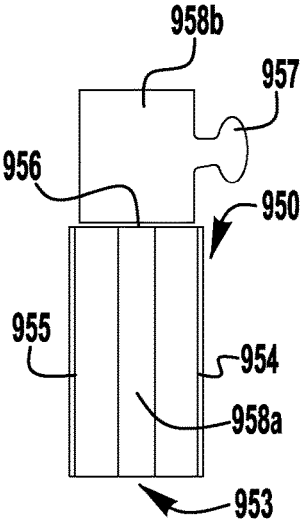
FIG. 9 is a cross-sectional schematic view of a structural bonding composite having a bonded reinforcing gasket and a sandwiched shim, in accordance with another exemplary embodiment of the present application.

In other embodiments, a structural bonding composite may utilize both an internal shim (or other such reinforcement member) and a laterally attached reinforcement member, for example, to provide additional reinforcement against compression of the composite's base member. FIG. 6 illustrates a structural bonding composite 650 including a base member 653 with an encapsulated shim 658*a* and a laterally bonded reinforcement member 658*b*. FIG. 7 illustrates a structural bonding composite 750 including a base member 753 with a sandwiched plate or shim 758*a* (or other such reinforcement member) and a laterally bonded reinforcement member 758*b*. FIG. 8 illustrates a structural bonding composite 850 including a base member 853 with an encapsulated shim 858*a* and a laterally bonded gasket 858*b*. FIG. 9 illustrates a structural bonding composite 950 including a base member 953 with a sandwiched shim 958*a* and a laterally bonded reinforcement gasket 958*b*.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, hardware, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

While the present invention has been illustrated by the description of embodiments thereof, and while the embodiments have been described in considerable detail, it is not the intention of the applicant to restrict or in any way limit the scope of the invention to such detail. Additional advantages and modifications will readily appear to those skilled in the art. For example, the specific locations of the component connections and interplacements can be modified. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A glazing system comprising:

a fenestration unit having opposed first and second major surfaces;

a frame member having a first major surface facing the first major surface of the fenestration unit;

a structural bonding composite interposed between the first major surface of the frame member and the first major surface of the fenestration unit, the structural bonding composite comprising:

a compressible base member having a first adhesive layer applied to a first side of the base member to define a first structural adhesive surface bonded to the first major surface of the frame member and a second adhesive layer applied to a second side of the base member to define a second structural adhesive surface opposite the first structural adhesive surface and bonded to the first major surface of the fenestration unit; and a reinforcement member secured to a portion of the base member to maintain a predetermined thickness of the base member against compression between the first major surfaces of the fenestration unit and the frame member, the predetermined thickness corresponding to a required face clearance between the first major surfaces of the fenestration unit and the frame member;

wherein the structural bonding composite independently provides a sufficient bond of the fenestration unit to the frame member without other fastening materials; and wherein the reinforcement member comprises a spacer bonded to a lateral edge portion of the base member, the spacer including a first side engaging the first major surface of the frame member and a second side engaging the second major surface of the fenestration unit.

2. The system of claim 1, wherein the spacer comprises a gasket.

3. The system of claim 2, wherein the gasket comprises a pre-set gasket.

4. The system of claim 2, wherein the gasket comprises at least one of rubber and thermal plastic.

5. The system of claim 1, wherein the base member comprises at least one of silicone and acrylic.

6. The system of claim 1, wherein the first and second adhesive layers comprise at least one of silicone and acrylic.

7. The system of claim 1, wherein the frame member comprises at least one of aluminum and stainless steel.

8. The system of claim 1, wherein the reinforcement member comprises a first reinforcement member, the system further comprising a second reinforcement member disposed within the base member.

9. The system of claim 8, wherein the second reinforcement member comprises a rigid shim.

10. The system of claim 1, wherein the fenestration unit comprises an insulation glass unit having a first glass panel defining the first major surface and a second glass panel defining the second major surface.

11. The system of claim 1, wherein the frame member comprises a flange portion extending around a lateral edge of the fenestration unit and defining a second major surface facing the second major surface of the fenestration unit.

12. The system of claim 1, wherein the structural bonding composite has a bonding tensile strength in accordance with ASTM C1401.

13. The system of claim 1, wherein the structural bonding composite has a shear strength in accordance with ASTM C1401.

14. The system of claim 1, wherein the predetermined thickness is about 0.25 inches.

15. The system of claim 1, wherein the first and second adhesive layers comprise at least one of an addition-cured silicone, a radiation cured silicone, and a condensation cured silicone.

16. A glazing system comprising:

a fenestration unit having opposed first and second major surfaces;

a frame member having a first major surface facing the first major surface of the fenestration unit;

a structural bonding composite interposed between the first major surface of the frame member and the first major surface of the fenestration unit, the structural bonding composite comprising a compressible base member having a first adhesive layer applied to a first side of the base member to define a first structural adhesive surface bonded to the first major surface of the frame member and a second adhesive layer applied to a second side of the base member to define a second structural adhesive surface opposite the first structural adhesive surface and bonded to the first major surface of the fenestration unit; and a reinforcement spacer secured between the first major surfaces of the fenestration unit and the frame member, adjacent to a first lateral edge of the base member, to maintain a predetermined thickness of the base member against compression between the first major surfaces of the fenestration unit and the frame member, the predetermined thickness corresponding to a required face clearance between the first major surfaces of the fenestration unit and the frame member;

wherein the structural bonding composite independently provides a sufficient bond of the fenestration unit to the frame member without other fastening materials.

17. The system of claim 16, wherein the reinforcement spacer comprises a gasket.

18. The system of claim 17, wherein the gasket comprises a pre-set gasket.

19. The system of claim 17, wherein the gasket comprises at least one of rubber and thermal plastic.

20. The system of claim 16, wherein the base member comprises at least one of silicone and acrylic.

21. The system of claim 16, wherein the first and second adhesive layers comprise at least one of silicone and acrylic.

22. The system of claim 16, wherein the structural bonding composite has a bonding tensile strength and a shear strength in accordance with ASTM C1401.

23. The system of claim 16, wherein the predetermined thickness is about 0.25 inches.

24. The system of claim 16, wherein the reinforcement spacer is bonded to the first lateral edge of the base member.

25. The sytem of claim 16, wherein the first adhesive layer, the second adhesive layer, and the reinforcement spacer comprise silicone material.

26. The system of claim 16, wherein the first and second adhesive layers comprise at least one of a radiation cured silicone and a condensation cured silicone.

* * * * *